US006586667B2

(12) United States Patent
Morita

(10) Patent No.: US 6,586,667 B2
(45) Date of Patent: Jul. 1, 2003

(54) MUSICAL SOUND GENERATOR

(75) Inventor: Toru Morita, Tachikawa (JP)

(73) Assignee: Sony Computer Entertainment, Inc., Tokyo (JP)

( * ) Notice: Subject to any disclaimer, the term of this patent is extended or adjusted under 35 U.S.C. 154(b) by 0 days.

(21) Appl. No.: 09/798,668

(22) Filed: Mar. 2, 2001

(65) Prior Publication Data

US 2001/0029833 A1 Oct. 18, 2001

(30) Foreign Application Priority Data

Mar. 3, 2000 (JP) ..... 2000-059347
Nov. 13, 2000 (JP) ..... 2000-344904

(51) Int. Cl.[7] ..... G10H 5/02
(52) U.S. Cl. ..... 84/659; 84/609; 84/610; 84/622; 84/634; 84/649; 84/650; 84/666
(58) Field of Search ..... 84/600–603, 609–610, 84/615, 618, 622–625, 634, 649–650, 653, 656, 659–660, 666

(56) References Cited

U.S. PATENT DOCUMENTS 5,750,911 A * 5/1998 Tamura ..... 84/615
6,107,559 A * 8/2000 Weinstock et al. ..... 84/634
6,166,314 A * 12/2000 Weinstock et al. ..... 84/609

FOREIGN PATENT DOCUMENTS

JP 4-348396 A 12/1992 ..... G10H/7/02
JP 10-228519 A 8/1998 ..... G06K/9/00
JP 9-185372 A 9/1998 ..... G10H/7/00
JP 9-244650 A 1/1999 ..... G10H/5/02

* cited by examiner

*Primary Examiner*—Marlon T. Fletcher
(74) *Attorney, Agent, or Firm*—Frommer Lawrence & Haug LLP; William S. Frommer; Hans R. Mahr

(57) ABSTRACT

A musical sound generator combines a software processing and a hardware processing. A sub CPU210 generates musical note data based on the musical score data 340. Main CPU110 refers to a sound source file, converts musical note data and generates PCM data. A sound processor 210 converts the musical note data at a sound synthesis circuit 221 to generate PCM data. D/A converter 222 converts the PCM data into analog signals. The speaker 300 receives the signals and emits the sound.

13 Claims, 5 Drawing Sheets

MUSICAL SOUND GENERATOR

The application claims a priority based on Japanese Patent Application No. 2000-59347 filed on Mar. 3, 2000 and Japanese Patent Application No. 2000-344904 filed on Nov. 13, 2000, the entire contents of which are incorporated herein by reference for all purpose.

BACKGROUND OF THE INVENTION

The present invention relates to a musical sound generation technique, and more particularly, to a technique of generating sound data based on software and hardware in a separate manner.

There have been known computer-controlled, musical sound generators which read musical score data and output sounds represented by the musical score data. In such a musical sound generator, the computer normally controls a sound processor dedicated for acoustic processing to synthesize a sound, followed by D/A conversion, and then the resultant sound is emitted from a loudspeaker.

SUMMARY OF THE INVENTION

However, sounds with more presence which send more realistic sensation have been sought after to meet the users' need. According to conventional techniques, a newly designed sound processor and newly produced hardware could be installed to a musical sound generator in order to satisfy the need. However, the development of such new hardware is costly and time-consuming. Therefore, the hardware-wise adaptation would not be readily achieved.

Meanwhile, if the processing is entirely performed software-wise, the processing takes so long that sounds are delayed. This is particularly disadvantageous when images and sounds are combined for output.

It is an object of the present invention to provide a musical sound generation technique according to which software processing and hardware processing are combined.

In order to achieve the above-described object, the following processing is performed according to the present invention. More specifically, a part of musical score data is taken and first digital data is output based on the taken musical score data. The processing is performed by a sound synthesis circuit. Another part of the received musical score data is read, and second digital data is generated based on the read musical score data. The processing is performed by a processor which has read a program describing the processing. The first and second digital data pieces are converted into analog signals. The processing is performed by a D/A converter.

DESCRIPTION OF THE PREFERRED EMBODIMENTS

An embodiment of the present invention will be now described in conjunction with the accompanying drawings.

Figure 1:
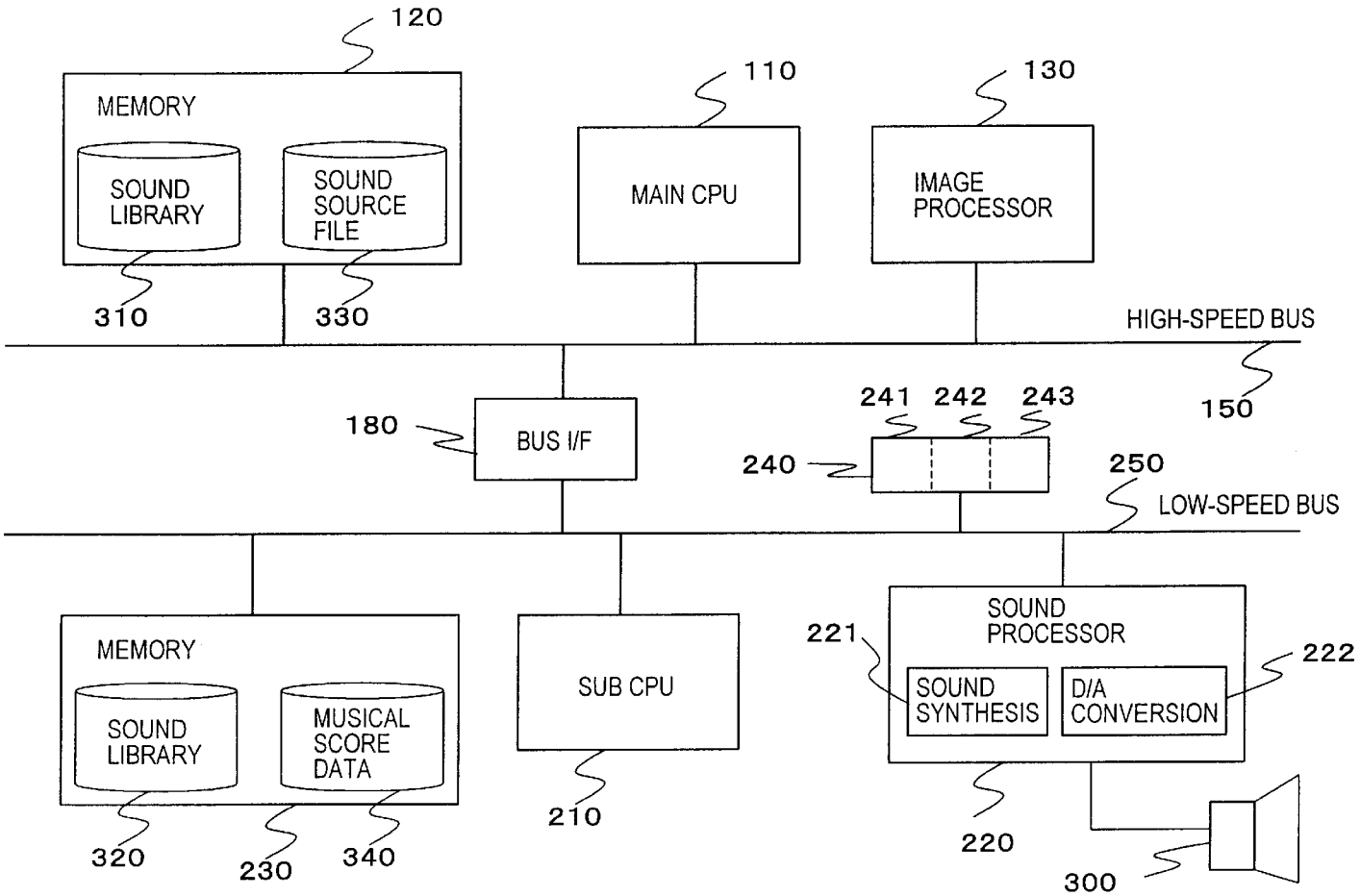
FIG. 1 is a diagram showing the hardware configuration of a musical sound generator according to an embodiment of the present invention.

FIG. 1 is a diagram showing a hardware configuration in a musical sound generator according to an embodiment of the present invention. The musical sound generator according to the embodiment is preferably applicable to an entertainment system which outputs a sound and an image in response to an external input operation.

The musical sound generator according to the embodiment includes a main CPU (Central Processing Unit) 110, a memory 120, an image processor 130, a sub CPU 210, a sound processor 220, a memory 230, a buffer 240, and a speaker 300. The main CPU 110, the memory 120, and the image processor 130 are connected by a high-speed bus 150, while the sub CPU 210, the sound processor 220, the memory 230 and the buffer 240 are connected by a low-speed bus 250. Furthermore, the high-speed bus 150 and the low-speed bus 250 are connected through a bus interface 240.

The memory 120 stores a sound library 310 and a sound source file 330. The memory 230 stores a sound library 320 and musical score data 340.

The buffer 240 has an MC region 241 which stores data to be transferred from the sub CPU 210 to the main CPU 110, an SP region 242 which stores data to be transferred from the sub CPU 210 to the sound processor 220, and a PCM region 243 which stores PCM data 350 to be transferred from the main CPU 110 to the sound processor 220.

Figure 4A:
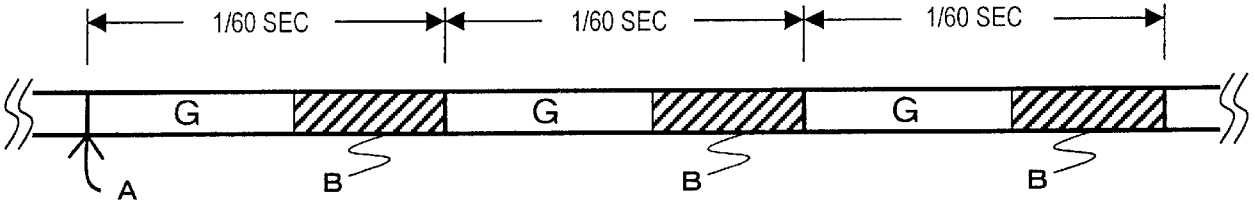
FIGS. 4(*a*) to 4(*c*) are charts showing the operation timings of a main CPU and a sub CPU according to the embodiment of the present invention.
Figure 4B:
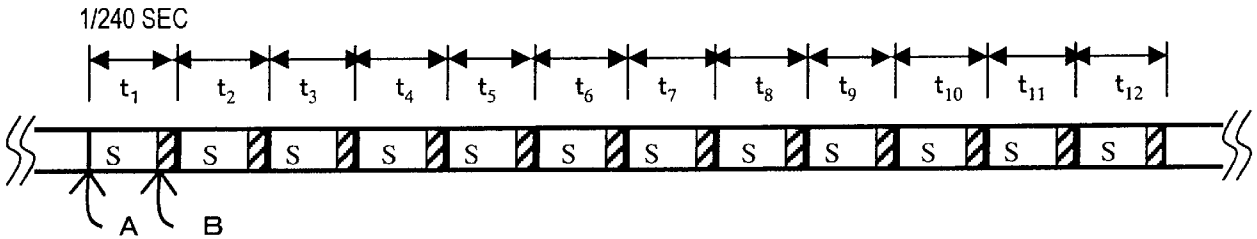
Figure 4C:
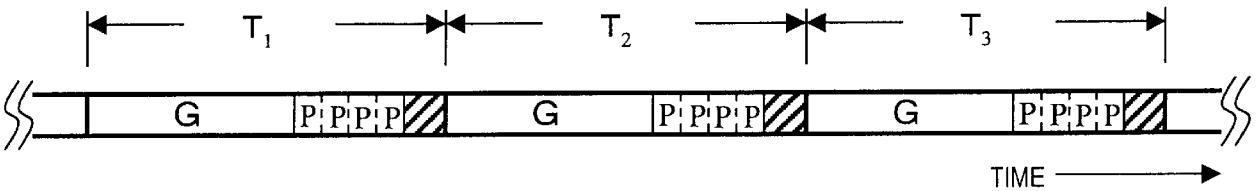

The main CPU 110 operates in a cycle of 60 Hz. The main CPU 110 for example may have a throughput of about 300 MIPS (million instructions per second). When this musical sound generator is applied to an entertainment system, the main CPU 110 mainly performs a processing for image output, and controls the image processor 130. More specifically, based on a clock signal generated by a clock generator which is not shown, a prescribed image output processing is performed within each cycle of 1/60 sec. The state of this performance is shown in FIG. 4(*a*). The main CPU 110 performs an image-related processing G on a 1/60-second basis. If the processing to be performed within the cycle is completed earlier, no processing is performed until the beginning of the next cycle. This unoccupied time B is used for a processing related to acoustic sound output which will be described (see FIG. 4(*c*)).

The processing related to acoustic sound output is performed by reading a prescribed program from the sound library 310. This will be now described in detail.

Figure 2:
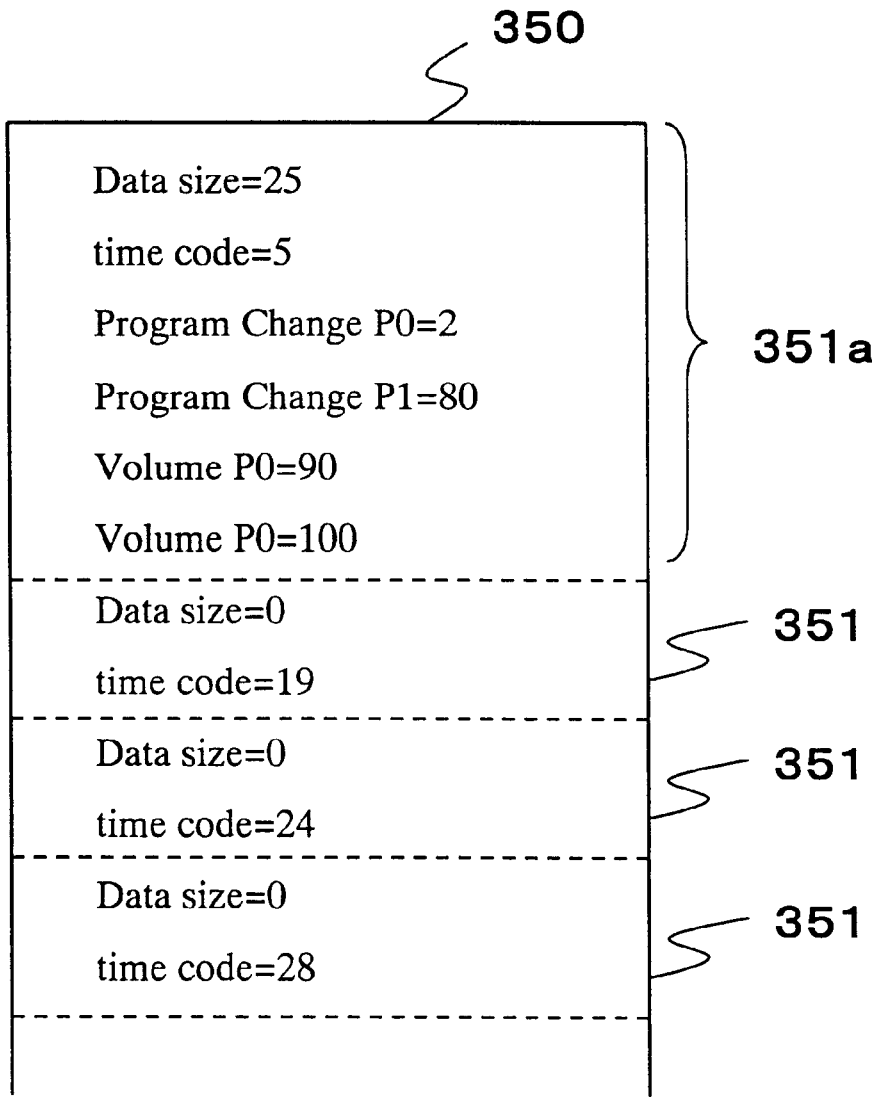
FIGS. 2 and 3 are diagrams each showing an example of musical note data stored in a buffer according to the embodiment of the present invention.
Figure 3:
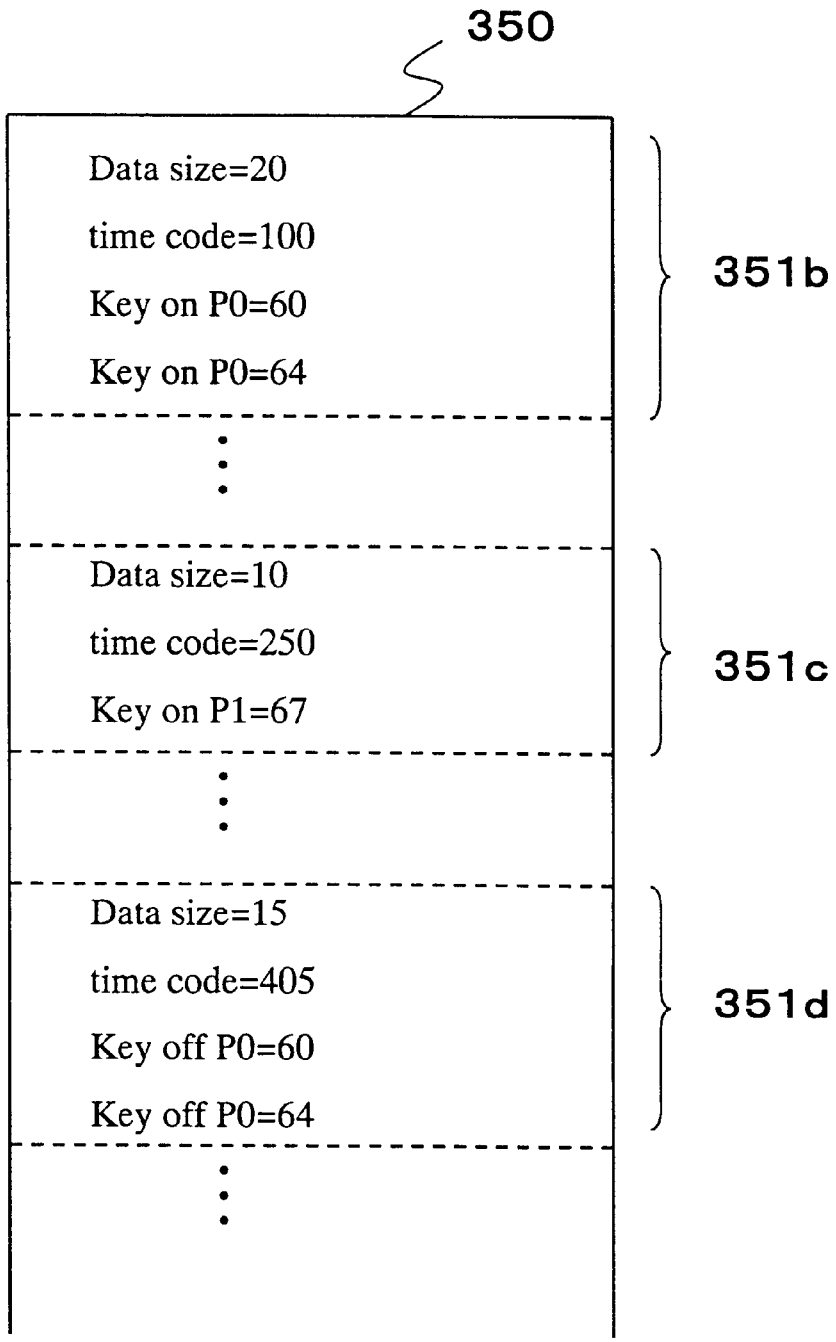

The main CPU 110 reads musical note data 350 from the MC region 241 in the buffer 240. Based on the read data, the main CPU 110 synthesizes a sound, and generates PCM (Pulse Code Modulation) data. The musical note data 350 is for example text data including a description of a tone and the sound state of the tone as shown in FIGS. 2 and 3. The musical note data represents for example a sound state related to at least one of sound emission, sound stop and the height of a sound to be emitted. The musical note data 350 is generated by the sub CPU 210 and stored in the MC region 241 or SP region 242 in the buffer 240. The musical note data 350 is formed in a block 351(351*a*, 351*b*, 351*c*, 351*d*) output in each cycle by the sub CPU 210.

An example of the musical note data shown in FIG. 2 is divided into four blocks. Each of the blocks 351 includes at least descriptions "Data size=XX" representing the size of the block, and "Time code=NN" representing time at which the block is generated. The time by the time code is in a milli-second representation. Note however that the time is used to comprehend time relative to other musical note data and does not necessarily have to coincide with actual time.

Instead of the time code, a serial number which allows the order of data generation to be determined may be used.

Furthermore, "Program Change P0=2" and "Program Change P1=80" included in a data block 351*a* mean "the musical instrument of identifier 2 is set for part 0" and "the musical instrument of identifier 80 is set for part 1", respectively. "Volume P0=90" and "Volume P1=100" mean "the sound volume of part 0 is set to 90" and "the sound volume of part 1 is set to 100", respectively.

"Key on P0=60" and "Key on P1=64" included in a data block 351*b* in FIG. 3 mean "Emit sound 60 (middle do) for part 0" and "Emit sound 64 (middle mi) for part 1", respectively. "Key on P1=67" included in a data block 351*c* means "Emit sound 67 (middle sol) for part 1." "Key off P0=60" and "Key off P1=64" included in a data block 351*d* mean "stop outputting sound 60 (middle do) for part 0" and "stop outputting sound 64 (middle mi) for part 1", respectively. These pieces of musical note data 350 are generated by the sub CPU 210 and stored in the MC region 241 in the buffer 240.

Figure 5:
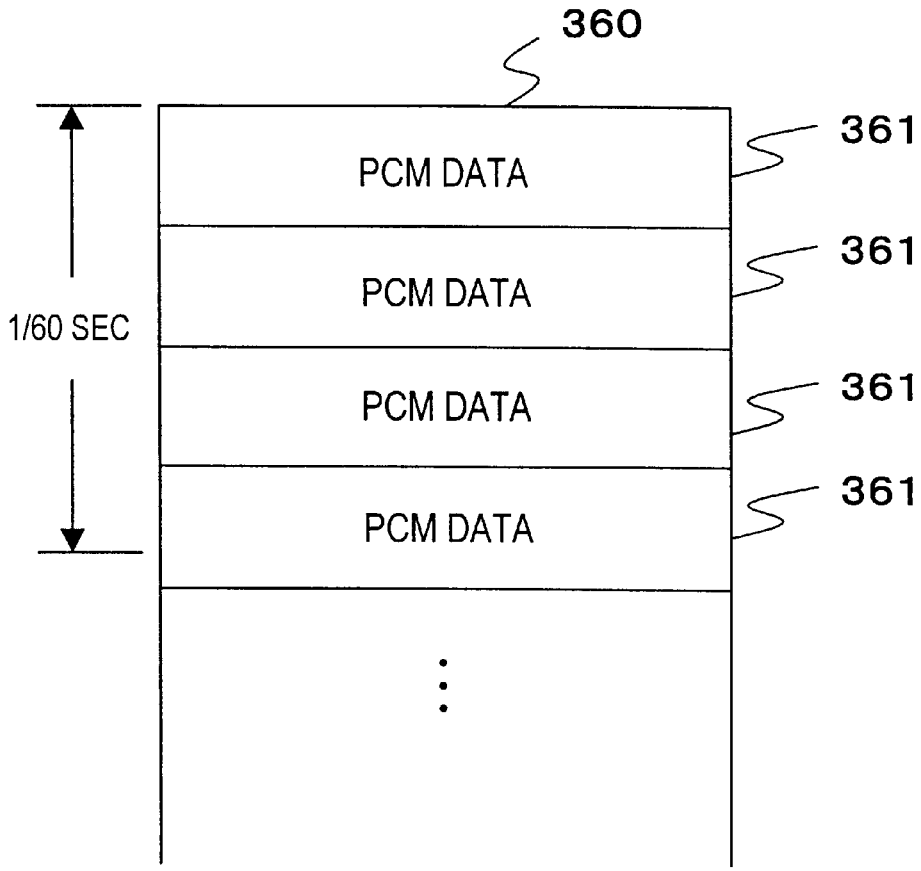
FIG. 5 is a diagram showing an example of PCM data stored in the buffer 240 according to the embodiment of the present invention.

The PCM data 360 is produced by taking out sound data corresponding to a sound state for each part indicated in the musical note data 350 from the sound source file 330, and synthesizing and coding the data. As shown in FIG. 5, the PCM data 360 is generated in individual blocks 361 and stored in the PCM region 243 in the buffer 240. Each blocks 361 is corresponding to data blocks 351 in the musical note data 350.

The image processor 130 performs a processing to allow images to be displayed at a display device which is not shown, under the control of the main CPU 110.

The sub CPU 210 operates in a cycle in the range from 240 Hz to 480 Hz. The sub CPU 210 may have for example a throughput of about 30 MIPS. Each of the following processing is performed by reading a prescribed program from the sound library 320.

The sub CPU 210 reads the musical score data 340 from the memory 230, and generates the musical note data 350 as shown in FIGS. 2 and 3. The generated musical note data 350 is stored in the buffer 240. Among the data, musical note data 350 to be processed by the main CPU 110 is stored in the MC region 241, while musical note data 350 to be processed by the sound processor 220 is stored in the SP region 242.

Here, the musical note data 350 to be processed by the sound processor 220 may be related for example to a base sound. The musical note data 350 to be processed by the main CPU 110 may be related to a melody line or related to a processing requiring a special effect.

The sound processor 220 generates sounds to be output from the speaker 300 under the control of the sub CPU 210. More specifically, the sound processor 220 includes a sound synthesis circuit 221, and a D/A conversion circuit 222. The sound synthesis circuit 221 reads the musical note data 350 generated by the sub CPU 210 from the SP region 242, and outputs PCM data 360 of a coded synthetic sound. The D/A conversion circuit 222 converts the PCM data 360 generated by the sound synthesis circuit 221 and the PCM data 360 generated by the main CPU 110 into analog voltage signals, and outputs the signals to the speaker 300.

The sound libraries 310 and 320 store modules for programs to perform processings for outputting a sound using this musical sound generator. The modules are for example an input processing module for reading the musical score data 340, a sound synthesis processing module for synthesizing a sound, a sound processor control module for controlling the sound processor, a special effect module for providing a special effect such as filtering and echoing processings and the like.

The sound source file 330 stores sound source data to be a base for synthesizing various sounds from various musical instruments.

The musical score data 340 is data produced by taking information represented by a musical score onto a computer.

The operation timings of the main CPU 110 and the sub PU 210 will be now described in conjunction with FIGS. 4(*a*) to 4(*c*). In any of charts in FIGS. 4(*a*) to 4(*c*), the abscissa represents time.

FIG. 4(*a*) is a timing chart for use in illustration of the state in which the main CPU 110 performs only the image-related processing G. The main CPU 110 operates periodically at 1/60. The image processing to be performed within each cycle starts from the origin A of the cycle. After the processing, the main CPU 110 does not perform any processing until the start of the next cycle. More specifically, unoccupied time B (the shadowed portion in the figures) for the CPU is created.

FIG. 4(*b*) is a timing chart for use in illustration of the state in which the sub CPU 210 performs the processing S of generating/outputting the musical note data 350. Here, the sub CPU 210 is considered as being under operation in a cycle of 1/240 sec. In the sub CPU 210, similarly to the main CPU 110, the processing to be performed within each cycle starts from the origin A of the cycle. After the generation and output of the musical note data, there is the unoccupied time B for the CPU until the start of the next cycle. Note that there are two kinds of the musical note data 350 generated by the sub CPU 210, one is directly processed by the sound processor 220 and the other is processed by the main CPU 110 and then transferred to the sound processor 220.

FIG. 4(*c*) is a timing chart for use in illustration of the case in which the main CPU 110 synthesizes a sound in the unoccupied time B. The cycle $T_2$ will be described byway of illustration. The musical note data 350 generated by the sub CPU 210 during cycle $t_3$ to $t_6$ is stored in the buffer 240. Among the data, the musical note data 350 stored in the MC region 241 is shown in FIG. 2. The main CPU 110 reads the musical note data 350 in the four blocks 351 for a prescribed processing.

At this time, the main CPU 110 performs the processing P of generating the PCM data 360 on each block of 351 in the order of time codes referring to the time codes. Here, since data for four cycles of operation by the sub CPU 210 is processed within one cycle of the main CPU 110, the data for the four cycles may be processed at a time. However, if the data is processed at a time, sound synthesis which could be otherwise achieved at a precision of 1/240 sec is performed at a lower precision of 1/60 sec. As described above, the PCM data is generated on a block basis, so that the precision can be prevented from being lowered.

During the image related processing G by the main CPU 110, the sub CPU 210 may generate an interrupt signal and temporarily suspend the image related processing so that the PCM data generation processing P may be performed. Note however that in this case, the efficiency of the image related processing is lowered. As a result, if the PCM data generation processing is performed by one operation after the image-related processing is completed, the processing may be performed without lowering the efficiency of the image-related processing.

The main CPU 110 stores each block 361 of PCM data 360 in the PCM region 243 in the buffer 240. The block 361 in the PCM data 360 corresponds to the block 351 in the musical note data 350. At the end of the processing for one cycle by the main CPU 110, the data amount of the PCM data 360 stored in the PCM region 243 corresponds to a data amount for not less than 1/60 sec in terms of output time as a sound from the speaker 300.

The sound processor 220 operates in the same cycle as that of the sub CPU 210. Therefore, it operates in a cycle of 1/240 sec here. In each cycle, the sound synthesis circuit 221 reads one block 351 of the musical note data 350 from the SP region 242 and generates PCM data 360. The generated PCM data 360 is converted into an analog voltage signal by the D/A conversion circuit 222.

Similarly, in each cycle, one block 361 of the PCM data 360 is read from the PCM region 243 and the data is converted into an analog voltage signal by the D/A conversion circuit 222.

Here, the data taken from the SP region 242 and the data taken from the PCM region 243 should be in synchronization. They are originally synchronized when they are output from the sub CPU 210. The data from the PCM region 243 however goes through the processing by the main CPU 110, and is therefore delayed by time used for the processing. Therefore, the data from the SP region 242 is read with a prescribed time delay.

As in the foregoing, in the musical sound generator according to the embodiment, the sound processor 220 may output the PCM data subjected to the synthesis processing by the sound synthesis circuit 221 in the sound processor 220 and the PCM data synthesized software-wise by the main CPU 110 in a combined manner.

Furthermore, the software processing can be relatively readily added, deleted, and changed, so that different sounds with variations may be output. In addition, a temporarily performed, special effect processing such as echoing and filtering or a special function which is not provided to the sound processor is performed by the main CPU 110, and a normal processing related to a base sound for example is performed by the sound processor 220, so that the load can be distributed as well as high quality sounds may be output.

According to the present invention, the software processing and hardware processing may be combined to generate high quality musical sounds.

What is claimed is:

1. A musical sound generator comprising a first processing system, a second processing system, and a sound processor, the first processing system comprising:

a reading unit to read musical score data;

a musical note data generation unit to convert the musical score data and to generate musical note data representing a sound state in each of at least one tone; and an output unit to output first musical note data to be processed by the sound processor and second musical note data to be processed by the second processing system in a separate manner based on the generated musical note data, the second processing system comprising:

a reading unit to read the second musical note data output by the first processing system;

a sound synthesis unit to generate first synthetic sound data produced by synthesizing a plurality of tones based on the read second musical note data; and an output unit to output the first synthetic sound data, the sound processor comprising:

a conversion circuit for reading the first musical note data output by the first processing system and generating second synthetic sound data produced by synthesizing a plurality of tones based on the musical note data; and a speaker for emitting a sound based on a combination of the first and second synthetic sound data, the conversion circuit and the speaker operating under the control of the first processing system.

2. The musical sound generator according to claim 1, wherein the first and second processing systems both periodically operate, the first processing system operating in a cycle shorter than the second processing system, the musical note data generation unit generates the musical note data in each cycle of the first processing system, the output unit outputs musical note data generated within one cycle of the first processing system as one block, each the block including identification information which allows the order of generation to be determined, and the synthetic sound generation unit generates the first synthetic sound data based on musical note data included in a plurality of the blocks in one cycle of the second processing system.

3. The musical sound generator according to claim 2, wherein the synthetic sound generation unit generates the first synthetic sound data for each block in the order of generation based on the identification information in the each block which allows the order of generation to be determined.

4. The musical sound generator according to claim 2, wherein the identification information which allows the order of generation to be determined is temporal information indicating the generation time.

5. The musical sound generator according to claims 3, wherein the identification information which allows the order of generation to be determined is temporal information indicating the generation time.

6. The musical sound generator according to claim 1, wherein the first musical note data is musical note data related to a base sound, and the second musical note data is musical note data related to a melody line.

7. The musical sound generator according to claim 2, wherein the first musical note data is musical note data related to a base sound, and the second musical note data is musical note data related to a melody line.

8. The musical sound generator according to claim 3, wherein the first musical note data is musical note data related to a base sound, and the second musical note data is musical note data related to a melody line.

9. The musical sound generator according to claim 4, wherein the first musical note data is musical note data related to a base sound, and the second musical note data is musical note data related to a melody line.

10. The musical sound generator according to claim 5, wherein the first musical note data is musical note data related to a base sound, and the second musical note data is musical note data related to a melody line.

11. An entertainment system comprising the musical sound generator according to claim 1.

12. The musical sound generator according to claim 1, wherein the musical note data represents a sound state related to at least one of sound emission, sound interruption, and the height of a sound to be emitted.

13. A method of generating a musical sound in a musical sound generator comprising a first processor, a second processor, and a sound processor, the first processor performing:

a reading processing of reading musical score data;

a musical note data generation processing of converting the musical score data and generating musical note data representing a sound state in each of at least one tone; and a processing of outputting first musical note data to be processed by the sound processor and second musical note data to be processed by the second processor based on the generated musical note data, the second processor performing:

a reading processing of reading the first musical note data output by the first processor;

a sound synthesis processing of generating first synthetic sound data produced by synthesizing a plurality of tones based on the read second musical note data; and a processing of outputting the first synthetic sound data, the sound processor performing, under the control of the first processor:

a processing of reading the first musical note data output by the first processor and generating second synthetic sound data produced by synthesizing a plurality of tones based on the musical note data; and a processing of allowing a speaker to emit a sound based on a combination of the first and second synthetic sound data.

* * * * *